United States Patent [19]

Wright et al.

[11] Patent Number: 4,683,716

[45] Date of Patent: Aug. 4, 1987

[54] BLADE TIP CLEARANCE CONTROL

[75] Inventors: William B. Wright, Leicester; Richard J. Flatman, Derby, both of England

[73] Assignee: Rolls-Royce plc, London, England

[21] Appl. No.: 815,059

[22] Filed: Dec. 31, 1985

[30] Foreign Application Priority Data

Jan. 22, 1985 [GB] United Kingdom ..... 8501554

[51] Int. Cl.[4] ..... F02K 3/02; F02K 1/46; F03D 11/00

[52] U.S. Cl. ..... 60/226.1; 60/262; 415/127; 415/171

[58] Field of Search ..... 60/226.1, 262, 266, 60/39.07, 39.75; 415/115, 116, 117, 127, 136, 137, 138, 139, 170 R, 171, 175, 177, 178, 180, 174

[56] References Cited

U.S. PATENT DOCUMENTS

| | | | |
|---|---|---|---|
| 3,085,398 | 4/1963 | Ingleson | 415/127 |
| 4,242,042 | 12/1980 | Schwarz | 415/116 |
| 4,247,247 | 1/1981 | Thebert | 415/171 |
| 4,329,114 | 5/1982 | Johnston et al. | 415/145 |
| 4,334,822 | 6/1982 | Rossmann | 415/127 |
| 4,472,108 | 9/1984 | Pask | 415/127 |

*Primary Examiner*—Louis J. Casaregola
*Assistant Examiner*—Timothy S. Thorpe
*Attorney, Agent, or Firm*—Cushman, Darby & Cushman

[57] ABSTRACT

The invention is particularly concerned with the control of blade tip clearance in high pressure compressors of gas turbine engines. The compressor comprises a rotor assembly having radially extending rotor blades and a stator assembly. The stator assembly comprises an inner casing and a cylindrical wall member spaced radially from the inner casing to form a chamber. The axial ends of the cylindrical wall member seal with and are moveable radially with respect to the inner casing. The casing has radially inner and radially outer stops to limit radial movement of the cylindrical wall member. The cylindrical wall member carries a ring of shroud segments which are spaced radially from the rotor blades by a clearance. A valve supplies relatively high pressure air from the downstream end of the compressor into the chamber to contract the cylindrical wall member onto the inner stops to give optimum clearance during cruise, or connects the chamber to relatively low pressure air in the fan duct by aperture in outer casing by pipes to allow the cylindrical wall member to expand to the outer stops to prevent rubbing during transients.

11 Claims, 6 Drawing Figures

BLADE TIP CLEARANCE CONTROL

The present invention relates to blade tip clearance control for gas turbine engines. This is particularly concerned with the control of blade tip clearance in high pressure compressors of gas turbine engines.

The compressors and turbines of gas turbine engines comprise one or more rotor assemblies or means carrying a plurality of rotor blades and an enclosing stator assembly or means. The tips of the rotor blades are spaced from shrouds forming part of the stator assembly or means by a clearance, but during operation of the gas turbine engine this clearance may vary considerably, so as to either cause rubbing between the rotor blades and the shroud or produce a large clearance which reduces the efficiency of the gas turbine engine.

It is desirable to find a blade tip clearance control for maintaining as small a clearance as possible between the tips of the rotor blades and the shrouds. It is also desireable to ensure that during engine transients, ie., during acceleration or deceleration, the blade tips do not rub on the shrouds as this produces increases in the clearance at steady conditions.

In operation a rotor means expands due to two causes, firstly the rotor means expands due to being rotated at high speeds, ie., centrifugal force, secondly the rotor means expands due to being heated by the working fluid passing through the compressor. The stator means, however, is stationary and only expands due to being heated by the working fluid. The expansion of the stator means has to be controlled in order to give a minimum clearance while avoiding rubbing during transients.

The present invention seeks to provide a blade tip clearance control which will provide an optimum clearance between the rotor blades and the shrouds during normal operation of the engine during cruise, and which will maintain an adequate clearance during engine transients to prevent rubbing between the rotor blades and shrouds.

Accordingly the present invention provides, a blade tip clearance control for a compressor of a gas turbine engine comprising a rotor means and a stator means, the rotor means having at least one circumferential arrangement of radially outward extending rotor blades and the stator means comprising a casing having an inner surface, a cylindrical wall member being spaced radially from the inner surface of the casing to form a chamber, the axial ends of the cylindrical wall member sealing with the casing but being moveable radially with respect to the casing, the casing having radially inner stops and radially outer stops to limit the radial movement of the cylindrical wall member, a ring of shroud segments being carried from the cylindrical wall member and defining the flow path of the compressor and being spaced radially from the rotor blades by a clearance, means for varying the pressure in the chamber, in operation the chamber being connected to a supply of relatively high pressure fluid to contract the cylindrical wall member radially onto the radially inner stops to give an optimum tip clearance during normal operation of the gas turbine engine, and the chamber being connected to a supply of relatively low pressure fluid during transients of the gas turbine engine to allow the cylindrical wall member to expand radially until it abuts the radially outer stops to maintain an adequate clearance to prevent rubbing between the shroud segments and the rotor blades.

The cylindrical wall member may carry at least one circumferential arrangement of radially inward extending stator vanes, the stator vanes being spaced radially from the rotor means by a clearance, the stator vanes being arranged axially alternately with the rotor blades, radial movement of the cylindrical wall member controlling the clearance between the stator vanes and the rotor means.

The at least one arrangement of radially inward extending stator vanes may be carried from and may be integral with the shroud segments.

The cylindrical wall member may have at least two axially spaced sets of circumferentially spaced hooks, the shroud segments may have at least two axially spaced sets of circumferentially spaced hooks, the hooks on the cylindrical wall member and shroud segments being engaged/disengaged by relative rotation of the shroud segments and cylindrical wall member.

The radially inner stops may comprise flanges on radially extending walls forming a part of the casing, at least one flange having axially extending fingers which engage in the circumferential spaces between the engaged hooks on the cylindrical wall member and shroud segments to prevent relative rotation of the cylindrical wall member and shroud segments.

The means for varying the pressure in the chamber comprises a valve which either supplies relatively high pressure air from the downstream end of the compressor to the chamber by a pipe to contract the cylindrical wall member onto the radially inner stops or connects the chamber to relatively low pressure air by a pipe and an aperture in an outer casing to expand the cylindrical wall member to the radially outer stops.

The aperture in the outer casing connects the chamber to air in the fan duct or air at atmospheric pressure.

The compressor may be a high pressure compressor.

The present invention will be more fully described by way of reference to the accompanying drawings in which.

Figure 1:
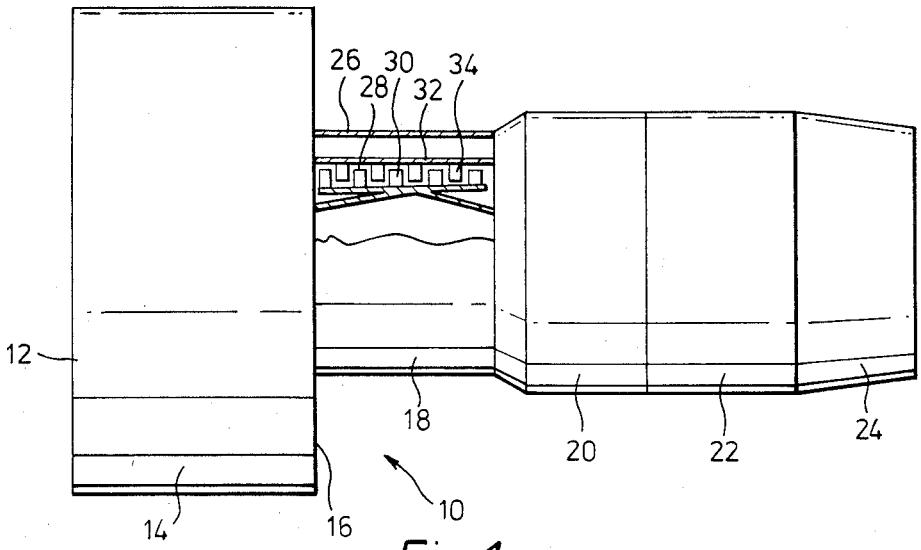
FIG. 1 is a partially cut-away view of a gas turbine engine showing a compressor having a blade tip clearance control according to the present invention.

FIG. 1 shows a gas turbine engine 10 which comprises in flow series an intake 12, a fan 14, a compressor 18, a combustor 20, a turbine 22 and an exhaust nozzle 24. There is also a fan duct 16. The compressor 18 comprises an outer casing 26 a rotor means 28 carrying several axially spaced circumferential arrangements of radially outward extending rotor blades 30. A stator means 32 is spaced radially from the rotor blades 30 by a clearance, and the stator means 32 carries several axially spaced circumferential arrangements of radially inward extending stator vanes 34. The rotor blades 30 and stator vanes 34 are arranged axially alternately.

The stator means 32 is shown more clearly in FIGS. 2, 4, 5 and 6 and comprises an intermediate casing 96 which carries inner casings 44 and 46 and cylindrical wall members 40 and 42 which are spaced radially from the inner surfaces of the inner casings 44 and 46 respectively to form chambers 48 and 50 respectively. The inner casing 44 comprises radial walls 52 and 54 which are attached to axial ends thereof, the walls 52 and 54 sealing with the axial ends of the cylindrical wall member 40 but allowing cylindrical wall member 40 to move radially with respect thereto. The radial walls 52 and 54 have flanges 56 and 58 respectively which extend axially and have outer surfaces defining radially inner stops 56' and 58' upon which the cylindrical wall 40 may rest, and the casing 44 has a number of axially spaced radially outer stops 60 extending from its inner surface.

Figure 5:
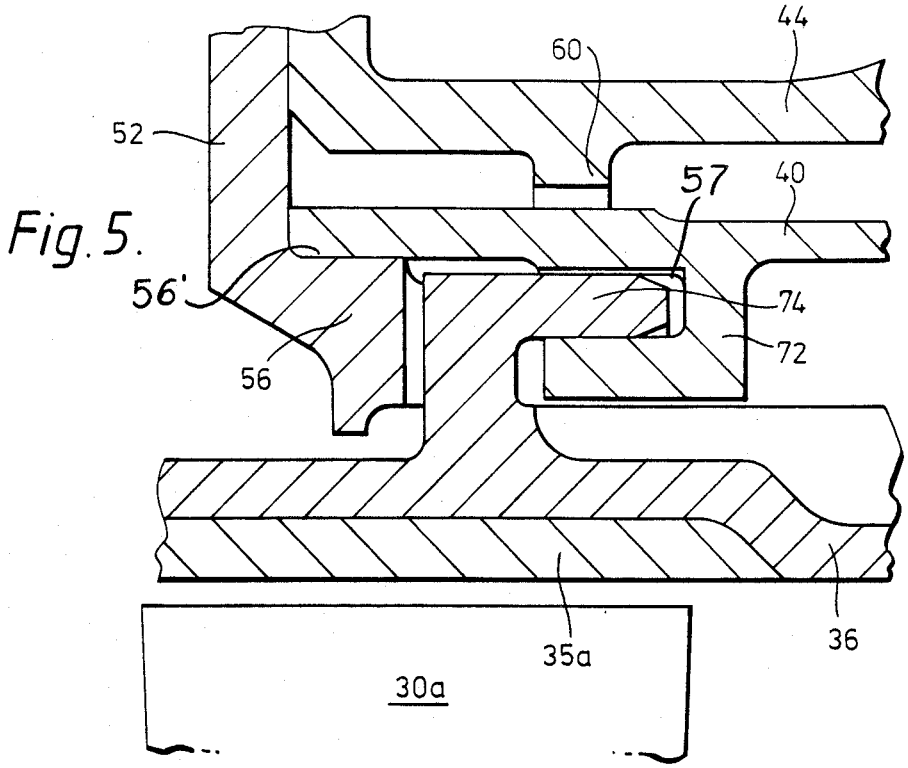
FIG. 5 is a section along line B—B of FIG. 4.
Figure 2:
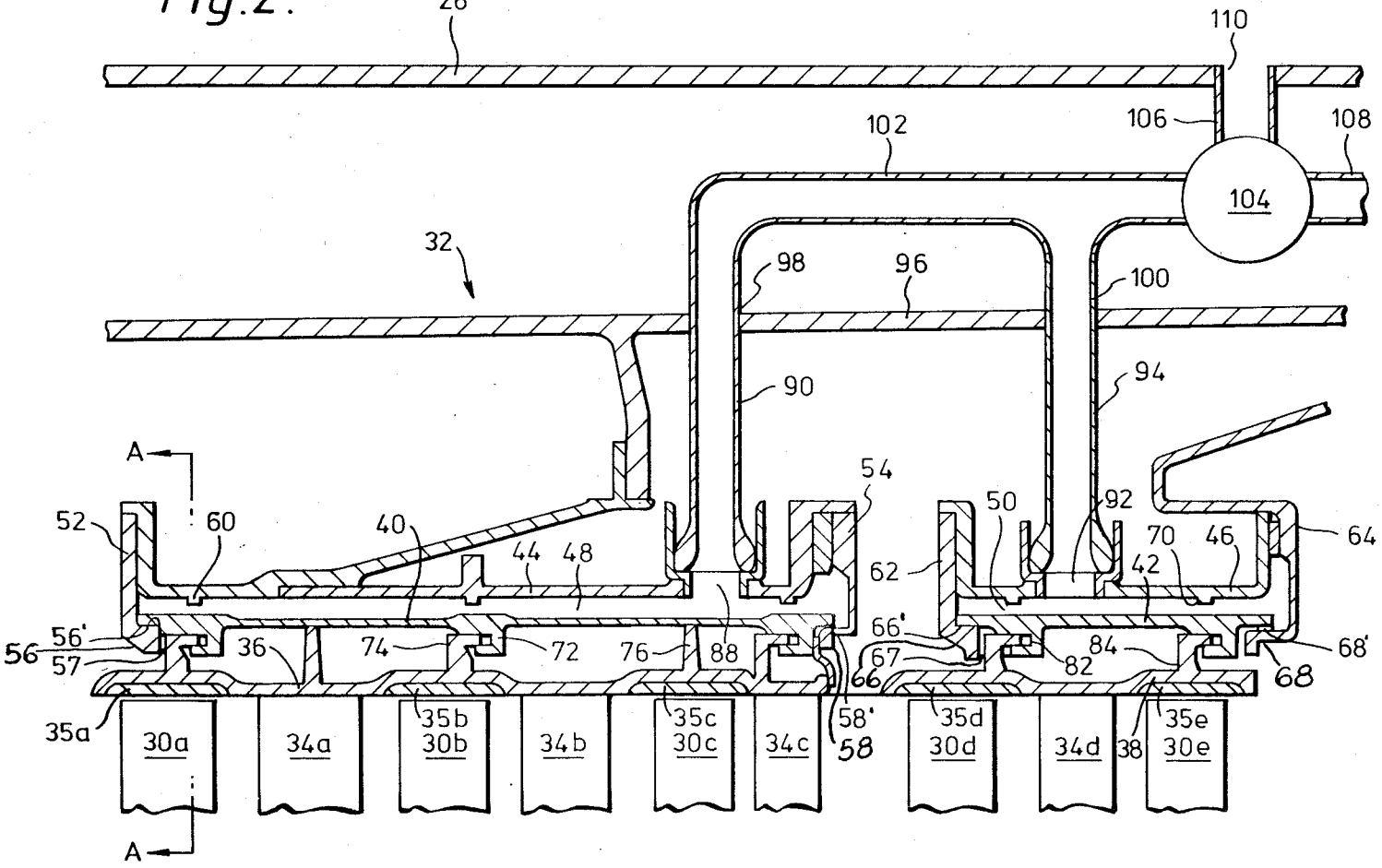
FIG. 2 is an enlarged view of the compressor and blade tip clearance control in FIG. 1.
Figure 6:
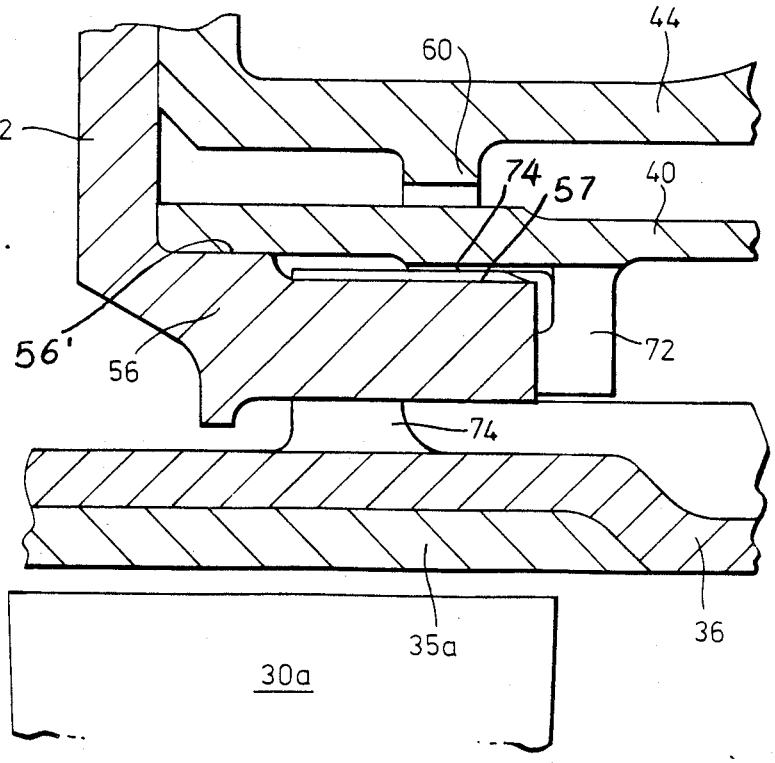
FIG. 6 is a section along line C—C of FIG. 4.

The cylindrical wall member 40 carries a ring of shroud segments 36, the cylindrical wall member 40 having axially spaced hooks 72 which cooperate with axially spaced hooks 74 on the shroud segments 36. The hooks 72 and 74 are not circumferentially continuous, but are circumferentially spaced on the cylindrical wall member 40 and shroud segments 36 respectively, so that the shroud segments 36 can be inserted axially into the cylindrical wall member 40 and then rotated so that the hooks 72 and 74 engage each other. To prevent rotation of the shroud segments 36, in operation, the flange 56 of the radial wall 52 is provided with axially extending fingers 57 which fit circumferentially between adjacent engaged hooks 72, 74 as best shown in FIGS. 2, 5 and 6.

The shroud segments 36 have axially spaced shroud portions 35*a*, 35*b* and 35*c* which are spaced radially from the rotor blades 30*a*, 30*b* and 30*c* respectively by a small clearance. The shroud segments 36 also carry stator vanes 34*a*, 34*b* and 34*c* which are positioned axially alternately with the shroud portions 35*a*, 35*b* and 35*c* and which form an integral structure therewith. The shroud segments 36 also have radially extending members 76 positioned intermediate the axially spaced hooks 74 to further support the shroud segments 36 and limit flexing of the cylindrical wall member 40.

The inner casing 44 has an aperture 88 and a pipe 90 fits and seals over the aperture 88 to supply fluid into the chamber 48. The pipe 90 extends through an aperture 98 in the intermediate casing 96 and is connected to a pipe 102. The pipe 102 is connected by a valve 104 to either a pipe 108 which supplies relatively high pressure fluid from the downstream end of the compressor or a pipe 106 which is connected by an aperture 110 in the outer casing 26 to the air at atmospheric pressure or air in the fan duct.

The inner casing 46 has radial walls 62 and 64 at its axial ends which seal with the axial ends of the cylindrical wall member 42 but allow the cylindrical wall member 42 to move radially. The radial walls 62 and 64 have flanges 66 and 68 respectively which extend axially and have outer surfaces defining radially inner stops 66' and 68' upon which the cylindrical wall member 42 may rest, and the casing 46 has a number of axially spaced radially outer stops 70 extending from its inner surface.

The cylindrical wall member 42 also carries a ring of shroud segments 38, the cylindrical wall member 42 having axially spaced hooks 82 which cooperate with axially spaced hooks 84 on the shroud segments 38. The hooks 82 and 84 are circumferentially spaced on the cylindrical wall member 42 and the shroud segments 38 respectively, so that the shroud segments 38 can be inserted axially into the cylindrical wall member 42 and then rotated so that the hooks 82 and 84 interengage. To prevent rotation of the shroud segments 38 the flange 66 of the radial wall 62 is provided with axially extending fingers 67 which fit circumferentially between adjacent engaged hooks 82, 84.

The shroud segments 38 have axially spaced shroud portions 35*d* and 35*e* which are spaced radially from the rotor blades 30*d* and 30*e* respectively by a small clearance. The shroud segments 38 also carry stator vanes 34*d* which are positioned axially between the shroud portions 35*d* and 35*e* and which form an integral structure therewith.

The inner casing 46 also has an aperture 92 and a pipe 94 fits and seals over the aperture 92 to supply fluid into the chamber 50. The pipe 94 extends through an aperture 100 in the intermediate casing 96 and is also connected to the pipe 102.

In operation the valve 104 allows relatively high pressure fluid to flow from pipe 108 via pipes 102 and 90 into chamber 48 and via pipes 102 and 94 into chamber 50. The relatively high pressure fluid in the chambers 48 and 50 acts on the cylindrical wall members 40 and 42 respectively causing the cylindrical wall members 40 to 42 to contract radially onto the radially inner stops 56', 58' and 66', 68' respectively of the flanges 56, 58 and 66, 68 to give an optimum clearance between the shroud portions 35*a*, 35*b*, 35*c*, 35*d* and 35*e* and the rotor blades 30*a*, 30*b*, 30*c*, 30*d* and 30*e* respectively during normal operation of the gas turbine engine ie., during cruise.

The valve 104 shuts off the supply of relatively high pressure fluid to the chambers 48 and 50, and allows the fluid in the chambers 48 and 50 to flow via pipes 90 and 102 and via pipes 94 and 102 respectively to and through the valve 104 to the pipe 106 and aperture 110 to atmosphere. Once the fluid in the chambers 48 and 50 is connected to atmospheric pressure the fluid flows to the atmosphere and the pressure in the chambers 48 and 50 reduces allowing the cylindrical wall members 40 and 42 respectively to expand radially under hoop tension until they abut the radially outer stops 60 and 70 respectively to maintain an adequate clearance between the shroud portions and rotor blades to prevent rubbing during engine transients.

The blade tip clearance control described can produce an improvement in specific fuel consumption (SFC) compared to blade tip clearance control systems of the thermal type ie., those using air or gases bled from the compressor, combustor or turbine to heat or cool the compressor shrouds. The SFC is improved because the present invention uses relatively small amounts of air drawn from the engine to contract the cylindrical wall members by pressure, compared to relatively large amounts of air or gas which are used to heat or cool the shroud continuously in the thermal systems.

Also a simpler pipe system for the air to contract the cylindrical member is required, smaller pipes and fewer in number which reduces complexity and weight.

The present blade tip clearance control has a rapid response rate, once the high pressure fluid in the chambers 48 and 50 is connected to the atmosphere the cylindrical wall members expand immediately to the radially outer stops 60 and 70 respectively.

The radially inner and outer stops can be machined to give precise increases in rotor tip clearance when required, compared to the imprecise thermal system.

Figure 3:
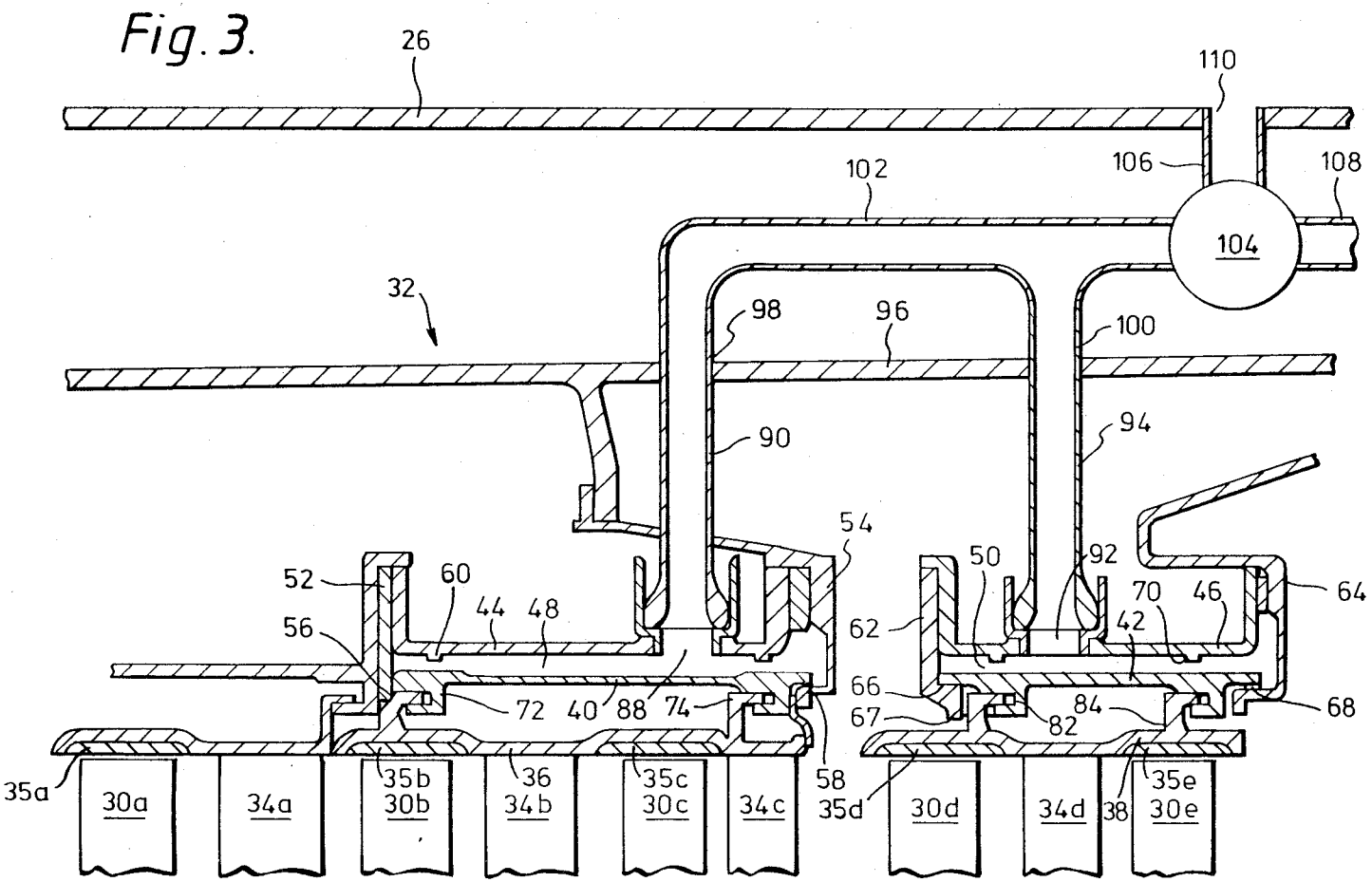
FIG. 3 is an enlarged view of the compressor and an alternative blade tip clearance control in FIG. 1.
Figure 4:
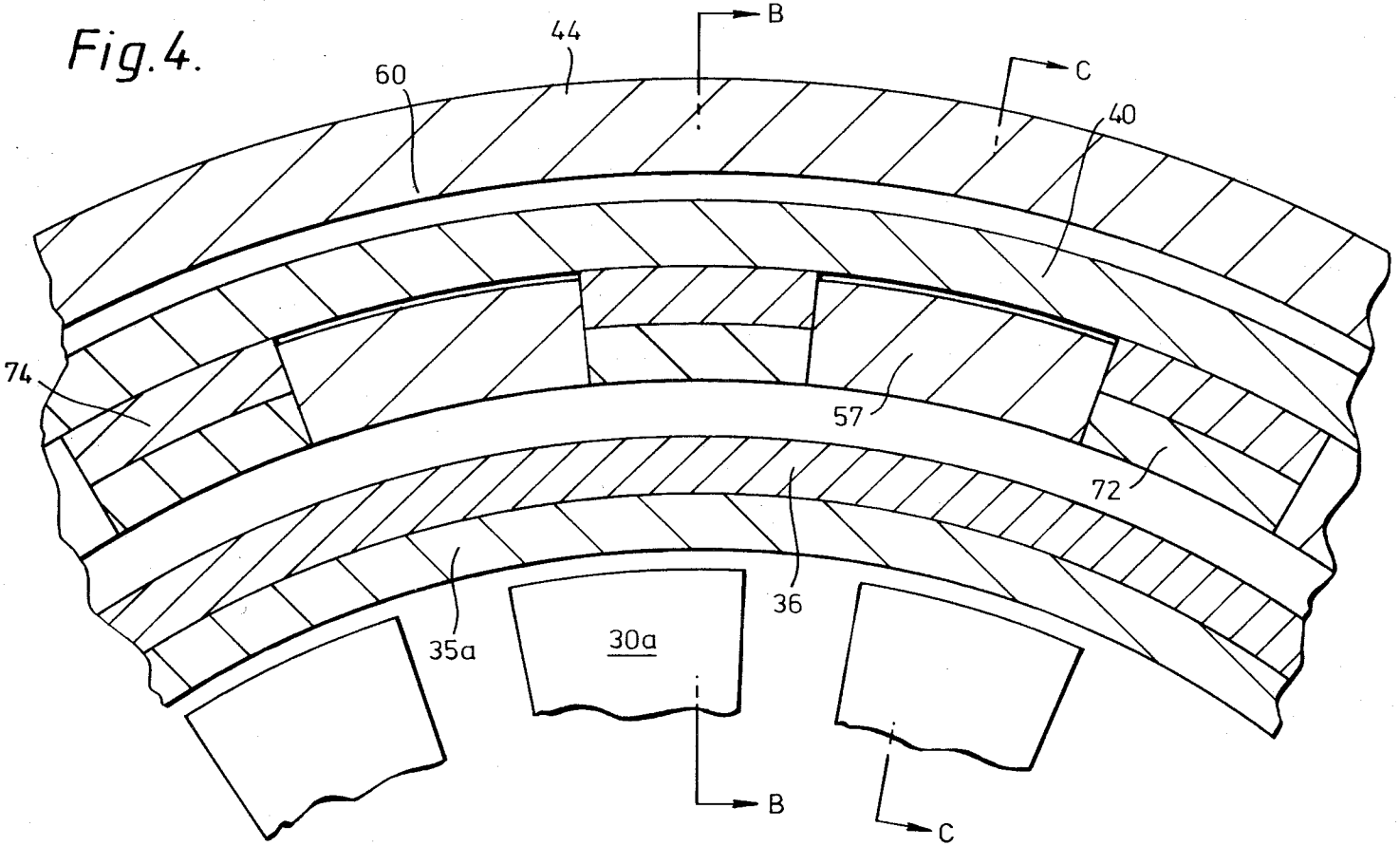
FIG. 4 is a section to an enlarged scale along line A—A of FIG. 2.

The embodiment in FIG. 3 is similar to that in FIG. 2 and operates in a similar manner, but the cylindrical wall member 44 carries a ring of shroud segments 36 which have axially spaced shroud portions 35*b* and 35*c*, and stator vanes 34*b* and 34*c* positioned alternately with the shroud portions to form an integral structure. Shroud 35*a* and vanes 34*a* are not carried by the cylindrical wall member. This reduces the axial length of the cylindrical wall member 44 and reduces flexing thereof.

Another advantage of the arrangements shown is that not only are the shroud portions moved radially away from the rotor blades, but also the inner ends of the stator vanes are moved radially away from the rotor means to prevent rubbing between the vanes and the rotor means.

We claim:

1. A blade tip clearance control for a compressor of a gas turbine engine comprising:

rotor means having plurality of rotor blades extending radially outwardly therefrom and being arranged circumferentially thereon;

stator means comprising a casing having an inner surface, a cylindrical wall member spaced radially inwardly from inner surface of said casing and having axial ends in sealing engagement with said casing to define a chamber therebetween, said cylindrical wall chamber and said axial ends thereof being movable as a unit radially toward and away from said inner surface of said casing in response to pressure changes in said chamber, radially inner stops on said casing adjacent at least each end thereof for abutting said axial ends of said cylindrical wall member to limit radial movement of said cylindrical wall member away from said inner surface of said casing, radial outer stops on said casing adjacent at least each end thereof for abutting said axial ends of said cylindrical wall member to limit radial movement of said cylindrical wall member towards said inner surface of said casing;

means for selectively varying pressure in said chamber to control movement of said cylindrical wall member and the axial ends thereof between said radially inner stops and said radially outer stops;

a ring of circumferentially arranged shroud segments defining a boundary flow path of said compressor, said ring shroud segments being spaced radially outwardly of said rotor blades by a clearance; and means carrying said shroud segments from said cylindrical wall member for movement therewith when said cylindrical wall member moves between said inner stops and said outer stops.

2. A blade tip clearance control for a compressor of a gas turbine engine as claimed in claim 1 in which said cylindrical wall member carries at least one circumferential arrangement of radially inwardly extending stator vanes spaced radially from said rotor means by a clearance, said stator vanes being arranged axially alternately with said rotor blades, said circumferential arrangement of stator vanes being moved radially between a first position and a second position by radial movement of said cylindrical wall member between said radially inner stops and said radially outer stops.

3. A blade tip clearance control for a compressor of a gas turbine engine as claimed in claim 1 in which said cylindrical wall member has at least two axially spaced sets of circumferentially arranged hooks, said shroud segments having at least two axially spaced set of circumferentially spaced hooks, said hooks on said cylindrical wall member and on said shroud segments being radially aligned and engaged to carry said shroud segments from said cylindrical wall member.

4. A blade tip clearance control for a compressor of a gas turbine engine as claimed in claim 3, including means to provide engagement and disengagement of said hooks on said cylindrical wall member and said shroud segments by relative rotation of said cylindrical wall member and said shroud segments.

5. A blade tip clearance control for a compressor of a gas turbine engine as claimed in claim 2 in which said at least one arrangement of radially inward extending stator vanes are carried from and are integral with said shroud segments.

6. A blade tip clearance control for a compressor of a gas turbine engine as claimed in claim 3 in which said cylindrical wall member has at least two axially spaced sets of circumferentially spaced hooks, shroud segments having at least two axially spaced sets of circumferentially spaced hooks said hooks on the cylindrical wall member and shroud segments being engaged/disengaged by relative rotation of said shroud segments and said cylindrical wall member.

7. A blade tip clearance control for a compressor of a gas turbine engine as claimed in claim 3 in which said radially inner stops comprise flanges on radially extending walls forming a part of said casing, at least one flange having axially extending fingers to engage in said circumferential spaces between the engaged hooks on said cylindrical wall member and said shroud segments to prevent relative rotation of said cylindrical wall member and said shroud segments.

8. A blade tip clearance control for a compressor of a gas turbine engine as claimed in claim 1 in which said means for varying pressure in said chamber comprises a valve, a first pipe means connected to said valve and connected to a downstream end of said compressor, and a second pipe means connected to said valve and to an aperture in an outer casing of said compressor.

9. A blade tip clearance control for a compressor of a gas turbine engine as claimed in claim 8, including a fan duct for said gas turbine engine, said aperture in said outer casing opening into said fan duct.

10. A blade tip clearance control for a compressor of a gas turbine engine as claimed in claim 1, including a carrying means at axial ends of said cylindrical member for carrying said shroud segments.

11. A blade tip clearance control for a compressor of a gas turbine engine as claimed in claim 1 in which the compressor is a high pressure compressor.

* * * * *